US007568987B2

(12) United States Patent
Mayer

(10) Patent No.: US 7,568,987 B2
(45) Date of Patent: Aug. 4, 2009

(54) HOCKEY STICK HAVING AN ANGLED SHAFT EXTENSION

(76) Inventor: Perry Lee Mayer, 5266 Hodgson Avenue, Niagara Falls, Ontario (CA) L2H 1M9

( * ) Notice: Subject to any disclaimer, the term of this patent is extended or adjusted under 35 U.S.C. 154(b) by 0 days.

(21) Appl. No.: 11/769,646

(22) Filed: Jun. 27, 2007

(65) Prior Publication Data

US 2009/0005197 A1 Jan. 1, 2009

(51) Int. Cl.
*A63B 59/14* (2006.01)

(52) U.S. Cl. ..... 473/560

(58) Field of Classification Search ..... 473/560–563
See application file for complete search history.

(56) References Cited

U.S. PATENT DOCUMENTS 4,553,753 A * 11/1985 Gibbons ..... 473/560
5,582,406 A * 12/1996 Babcock ..... 473/562
5,816,961 A * 10/1998 Kraemer ..... 473/560
5,967,913 A * 10/1999 Sulenta ..... 473/560
6,004,234 A * 12/1999 Majchrowicz ..... 473/560
6,248,031 B1 * 6/2001 Brodie ..... 473/560
6,364,792 B1 * 4/2002 Evanochko ..... 473/560
7,288,036 B2 * 10/2007 Casasanta, Jr. ..... 473/560
2006/0100043 A1 * 5/2006 David ..... 473/560

FOREIGN PATENT DOCUMENTS

CH 685149 A5 * 4/1995

* cited by examiner

*Primary Examiner*—Mark S Graham
(74) *Attorney, Agent, or Firm*—Miles & Stockbridge P.C.

(57) ABSTRACT

A hockey stick having an angled shaft extension comprises an elongate shaft having an upper end and a lower end and defining a shaft longitudinal axis, and is graspable by a hockey player. The upper end has a substantially hollow central portion. A blade is securely connected to the elongate shaft at its lower end and is for contacting a hockey puck. A shaft extension has a grippable portion having a lower end and an upper end, and defining a grip longitudinal axis extending between the lower end and the upper end, and an insert portion securely connected to the grippable portion at the lower end thereof. The insert portion is insertable into the substantially hollow central portion of the upper end of the elongate shaft, to thereby securely connect the shaft extension to the elongate shaft such that the grip longitudinal axis is angled below the shaft longitudinal axis.

2 Claims, 11 Drawing Sheets

HOCKEY STICK HAVING AN ANGLED SHAFT EXTENSION

FIELD OF THE INVENTION

The present invention relates to hockey sticks, and more particularly to hockey stick handles. Specifically, a hockey stick having an improved handle shape that improves feel, manipulation, handling and control of the hockey stick, is disclosed.

BACKGROUND OF THE INVENTION

The sport of hockey has been in existence for over one hundred years. Over that time period, many improvements have been made to hockey sticks; however, hockey sticks have remained substantially the same shape. It is well known that conventional hockey sticks comprise an elongate shaft and an angled blade securely connected to the lower end of the shaft. The blade may be permanently connected to the shaft or in other words, the hockey stick may be constructed as a unitary entity, or the blade may be removably mounted on the shaft, such as in the case of an aluminum or composite shaft. In any case, the shaft may be cut to an appropriate length for use by a hockey player.

Almost universally, the top end of the shaft of the hockey stick is either taped to provide a stop for precluding the hockey stick from slipping out of a person's hand. Alternatively, a moulded plastic end cap can be used. Further, hockey tape can be wound around the top few inches of the shaft to provide an improved grip for the hockey player's upper hand, or in other words the hockey player's hand that is gripping the upper end of the hockey stick.

As is well known, this arrangement is not ergonomic, and can tend to cause strain on the hand and wrist holding the upper end of the hockey stick. Further, the wrist is bent inappropriately, therefore providing for a less than maximum control. What typically happens is that a hockey player holds the taped butt end of the stick in the palm of his upper hand, which is undesirable, since it promotes lack of control of the hockey stick and allows the hockey stick to be more easily dropped.

In U.S. Pat. No. 4,553,753 issued Nov. 19, 1985 to Gibbons, discloses an Angular Hockey Stick Grip, that is adapted to fit onto standard hockey stick shafts. The Angular hockey stick grip has a lower socket portion adapted to fit over the end of a conventional hockey stick and an integral angled gripping portion that intersects the socket portion at an angle of approximately 130 degrees. The handle is constructed of light weight plastic and is removably fastened to the hockey stick by means of suitable fasteners, such as threaded fasteners. While this angular hockey stick grip does make an attempt to provide additional comfort, it has several unacceptable drawbacks. Firstly, it is not usable in some hockey leagues. Secondly, it must fit over the top end of a conventional hockey stick. Accordingly, the lower socket portion must be substantially thicker than a conventional hockey stick. In use, when a hockey player has his upper hand on the angled gripping portion, it must pass over the enlarged lower socket portion to slide onto the shaft of the hockey stick, which would have a very uncomfortable end unnatural feel to it. Further, when sliding the upper hand back along the shaft to the angled gripping portion, the sliding movement of the upper hand would be impeded by the enlarged lower socket portion, which would be highly undesirable.

U.S. Pat. No. 6,364,792, issued Apr. 2, 2002 to Evanochko, discloses an Ice Hockey Stick having an elongate handle with a curved portion at the upper end of the handle. The curved portion is continuously and smoothly curved from the straight line of main shaft to the butt end of the hockey stick. This design is highly undesirable in that the effective angle of the upper handle portion continuously changes along its length, since it is curved. Accordingly, the angle at which the hockey player's upper hand holds the grip changes depending where the hand is on the grip, thus making it virtually impossible to find a consistent gripping angle.

It is an object of the present invention to provide a hockey stick having a comfortable upper grip.

It is another object of the present invention to provide an ergonomic hockey stick having a comfortable upper grip.

It is a further object of the present invention to provide a hockey stick having comfortable upper grip that does not strain a hockey player's upper hand and wrist.

It is a further object of the present invention to provide a hockey stick having comfortable upper grip that provides for maximum control of the hockey stick.

It is a further object of the present invention to provide a hockey stick having comfortable upper grip that permits easy sliding action of the hockey player's upper hand between the upper grip and the hockey stick shaft.

SUMMARY OF THE INVENTION

In accordance with one aspect of the present invention there is disclosed a novel hockey stick having an angled shaft extension. The hockey stick comprises an elongate shaft having an upper end and a lower end and defining a shaft longitudinal axis. The elongate shaft is for grasping by the lower hand of a hockey player. The upper end has a substantially hollow central portion. A blade is securely connected to the elongate shaft at its lower end, and is for contacting a hockey puck. A shaft extension has a grippable portion having a lower end and an upper end, and defining a grip longitudinal axis extending between the lower end and the upper end. The shaft extension also has an insert portion securely connected to the grippable portion at the lower end thereof. The insert portion is insertable into the substantially hollow central portion of the upper end of the elongate shaft, to thereby securely connect the shaft extension to the elongate shaft such that the grip longitudinal axis is angled below the shaft longitudinal axis.

In accordance with another aspect of the present invention there is disclosed a novel shaft extension for use with a hockey stick having an elongate shaft defining a grip longitudinal axis and having an upper end with a substantially hollow central portion. The shaft extension comprises a grippable portion having a lower end and an upper end and defining a grip longitudinal axis extending between the lower end and the upper end. An insert portion is securely connected to the grippable portion at the lower end thereof. The insert portion is insertable into the substantially hollow central portion of the upper end of the elongate shaft, to thereby securely connect the shaft extension to the elongate shaft such that the grip longitudinal axis is angled below the shaft longitudinal axis.

In accordance with yet another aspect of the present invention there is disclosed a novel hockey stick having an angled shaft extension. The hockey stick comprises an elongate shaft having an upper end and a lower end and defining a shaft longitudinal axis. The elongate shaft is for grasping by the lower hand of a hockey player. A blade is securely connected to the elongate shaft at said lower end, and is for contacting a hockey puck. A shaft extension has a grippable portion having a lower end and an upper end, and defining a grip longitudinal axis extending between the lower end and the upper end. The shaft extension is securely connected to the elongate shaft such that the grip longitudinal axis is angled below the shaft longitudinal axis.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the hockey stick having an angled shaft extension according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF THE PREFERRED EMBODIMENTS

Figure 7:
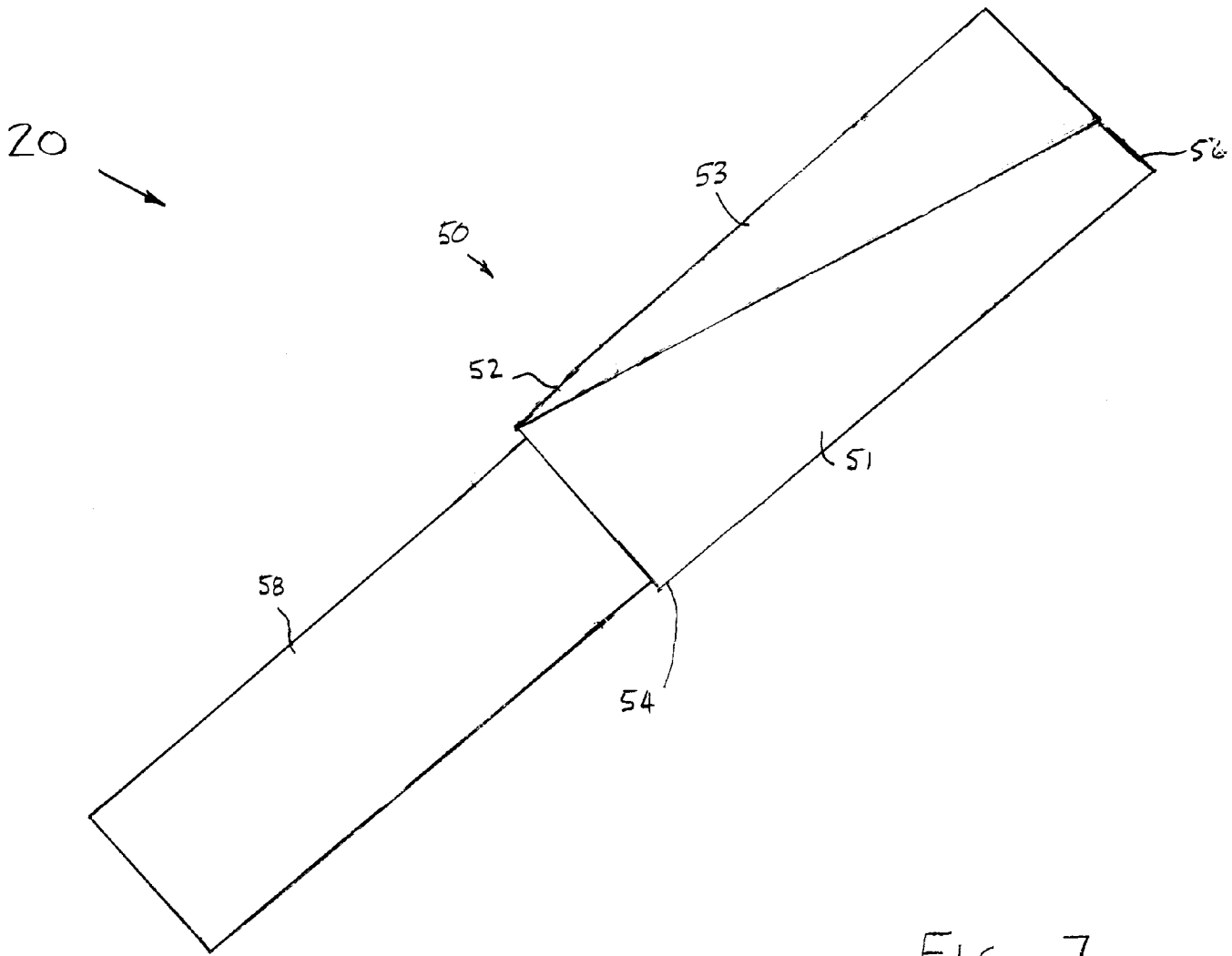
FIG. 7 is a side elevational view of the upper grip portion of FIG. 5, but having been changed to an alternative shape.
Figure 8:
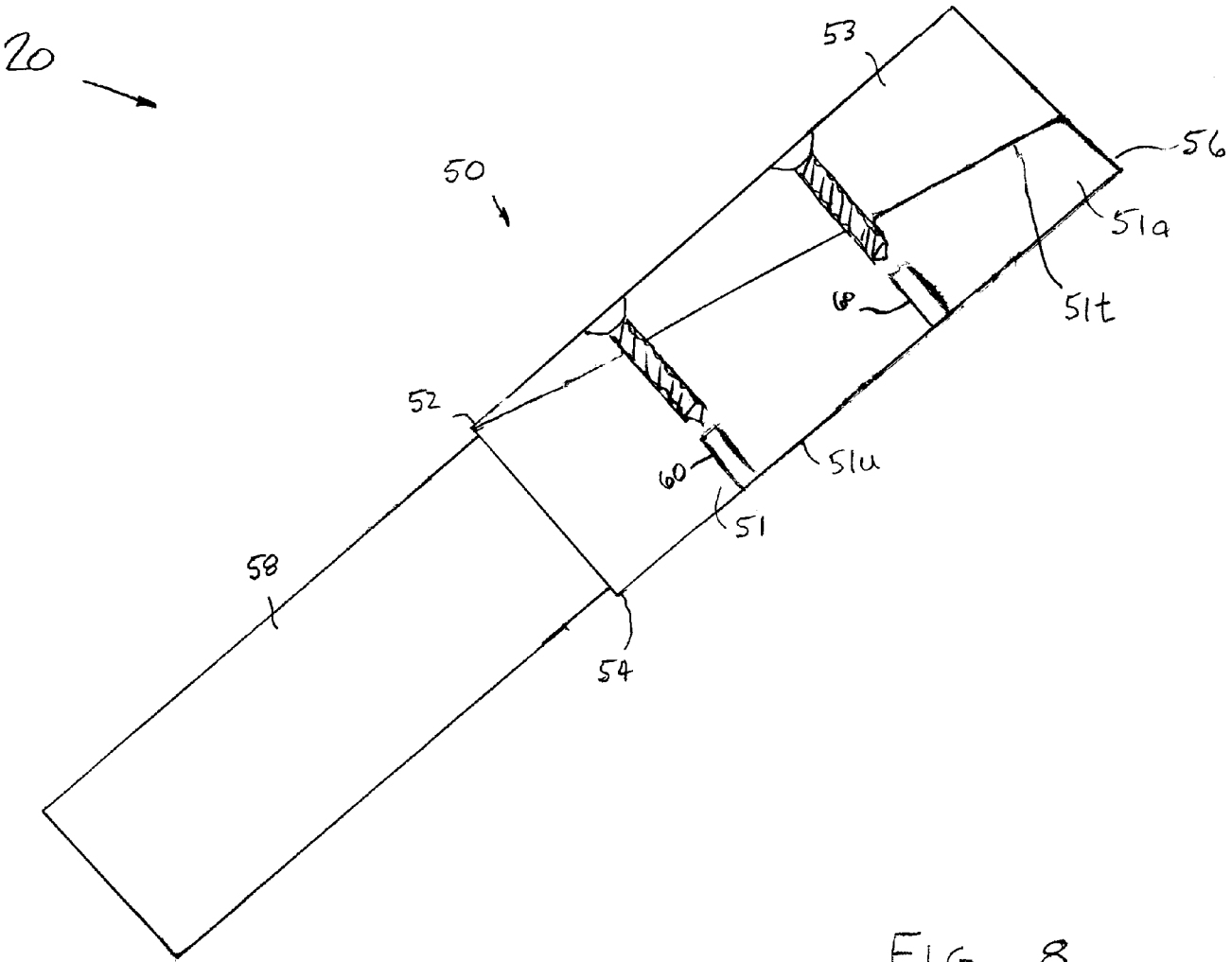
FIG. 8 is a side elevational view similar to FIG. 7, but with a portion cut away for the sake of clarity.
Figure 9:
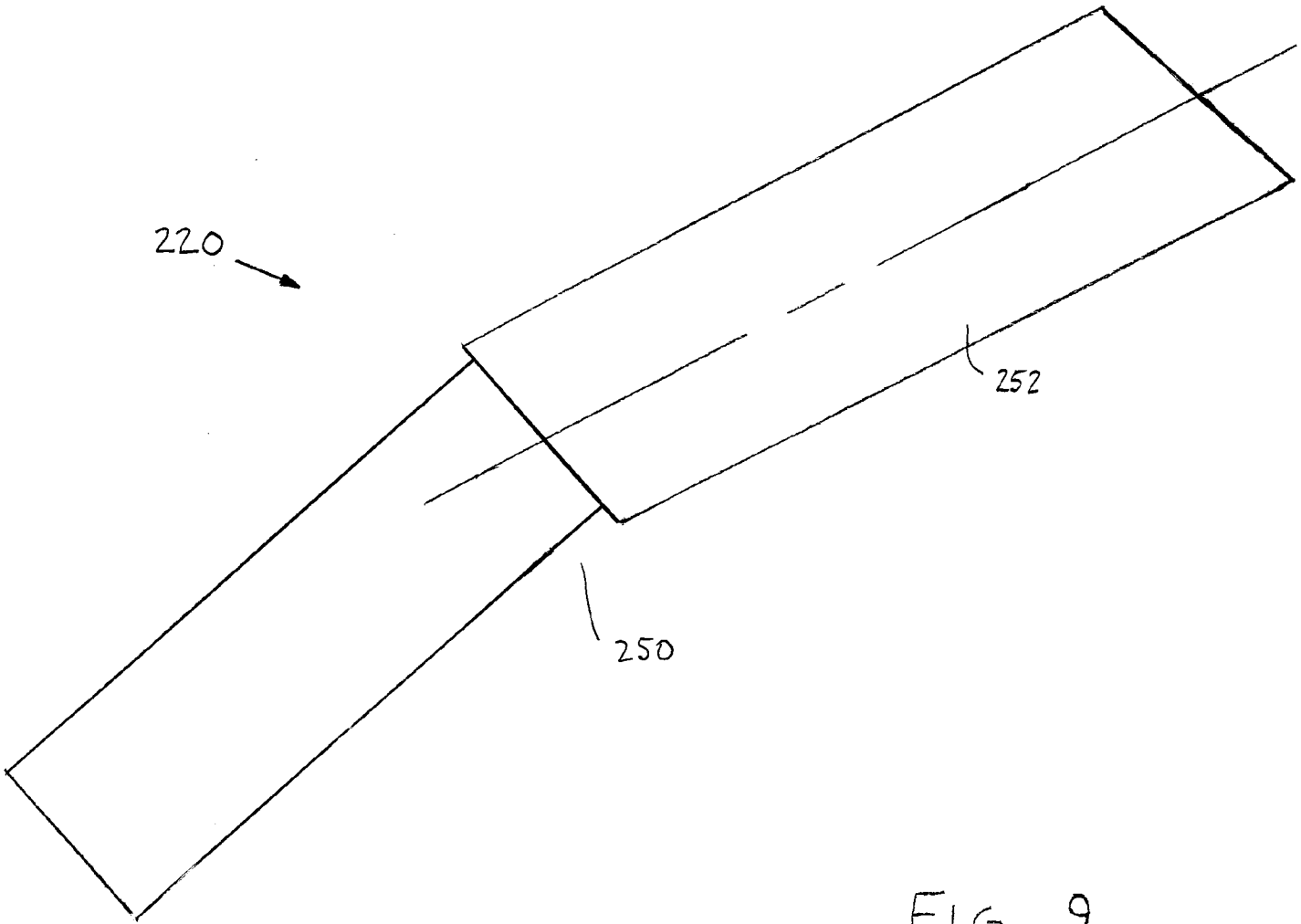
FIG. 9 is a side elevational view of a second preferred embodiment of the hockey stick having an angled shaft extension according to the present invention, specifically showing the upper grip portion not installed in a hockey stick; and, FIG. 10 is a side elevational view of a third preferred embodiment of the hockey stick having an angled shaft extension according to the present invention.
Figure 10:
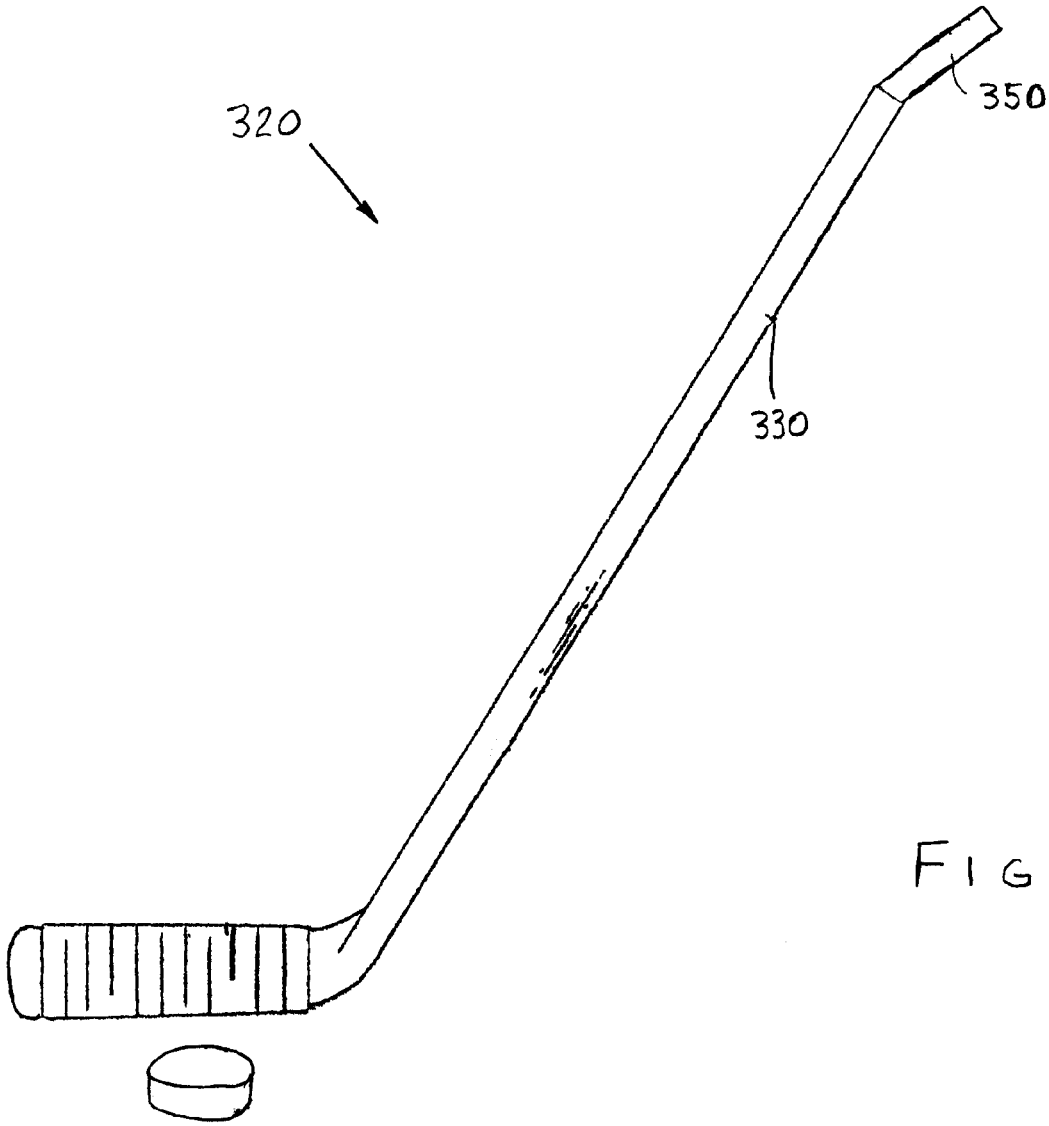
Figure 11:
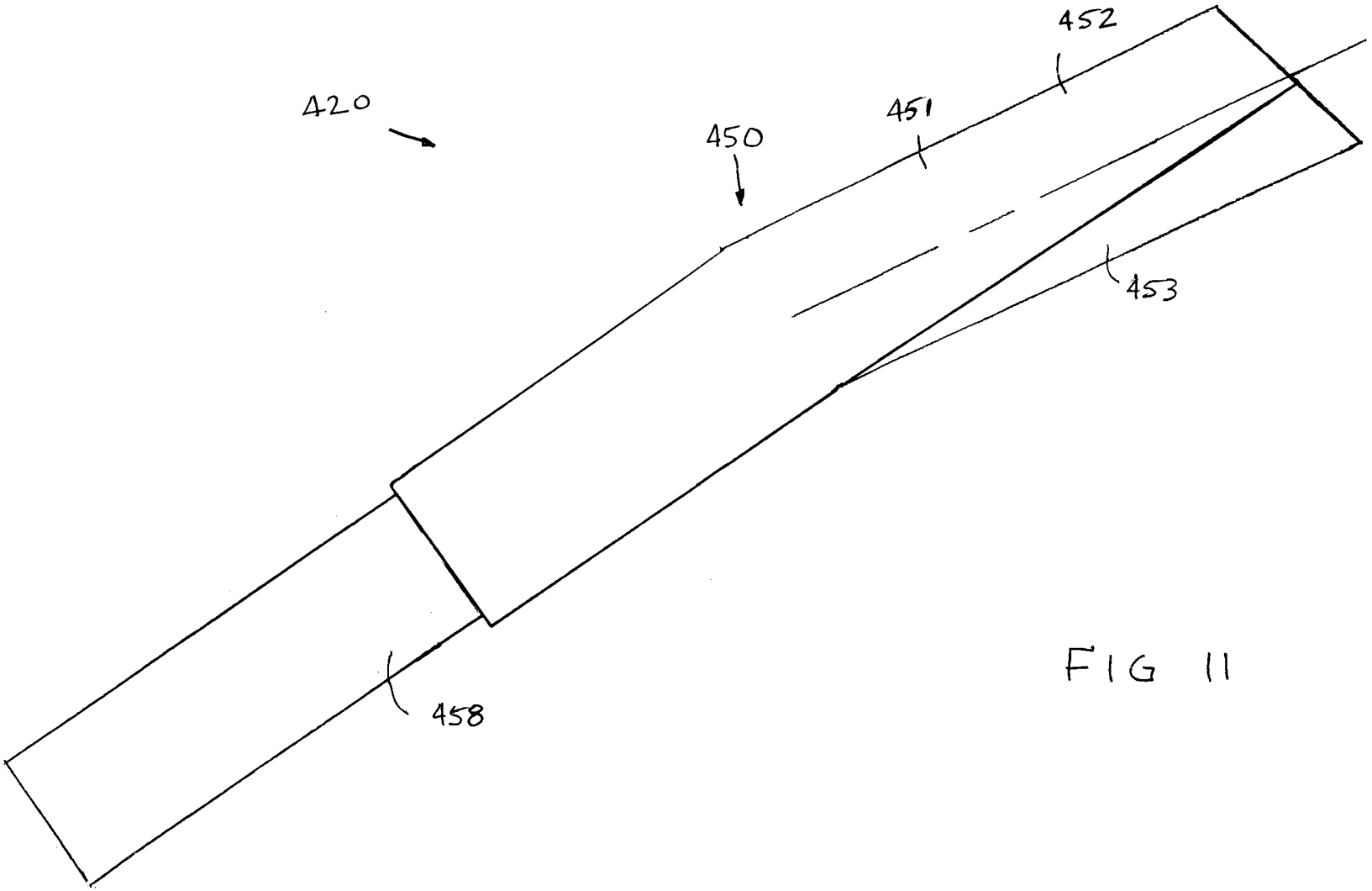
FIG. 11 is a side elevational view of a fourth preferred embodiment of the hockey stick having an angled shaft extension according to the present invention.

Referring to FIGS. 1 through 8 of the drawings, it will be noted that FIGS. 1 through 8 illustrate a first preferred embodiment of the hockey stick having an angled shaft extension according to the present invention, FIG. 9 illustrates a second preferred embodiment of the hockey stick having an angled shaft extension according to the present invention, FIG. 10 illustrates a third preferred embodiment of the hockey stick having an angled shaft extension according to the present invention, and FIG. 11 illustrates a fourth preferred embodiment of the hockey stick having an angled shaft extension according to the present invention Reference will now be made to FIGS. 1 through 8, which show a first preferred embodiment of the hockey stick, as indicated by general reference numeral 20, having an angled shaft extension, as indicated by general reference numeral 30. The hockey stick 20 comprises an elongate shaft 30 having an upper end 32 and a lower end 34. The elongate shaft 30 also defines a central shaft longitudinal axis "S", as can be best seen in FIG. 1. The elongate shaft 30 is for grasping by the lower hand of a hockey player, in a conventional manner. The upper end 32 of the elongate shaft 30 has substantially hollow central portion 36, and in the first preferred embodiment, as illustrated, the elongate shaft 30 is substantially hollow, and is a conventional composite hockey stick shaft.

Figure 1:
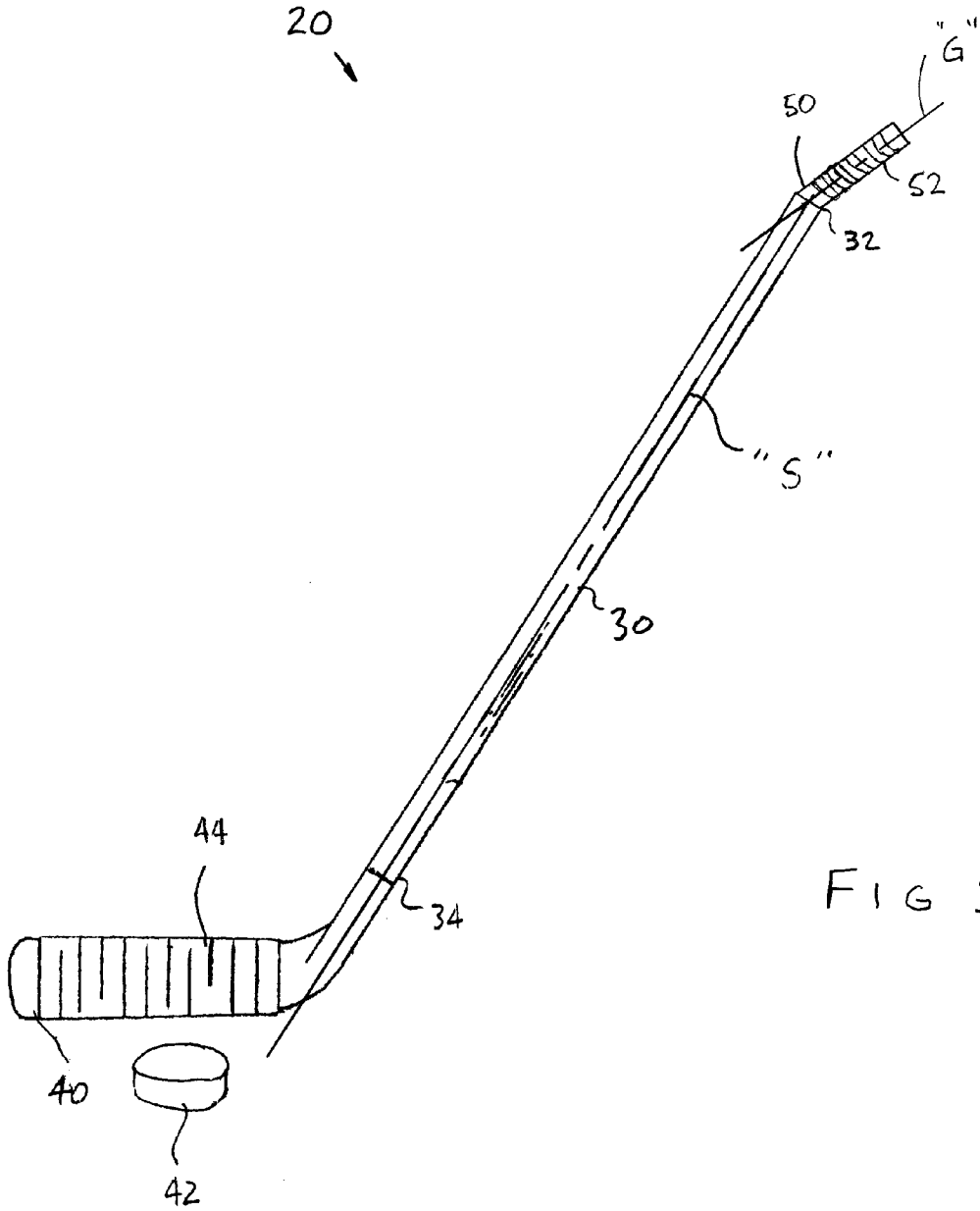
FIG. 1 is a side elevational view of a first preferred embodiment of the hockey stick having an angled shaft extension according to the present invention.
Figure 2:
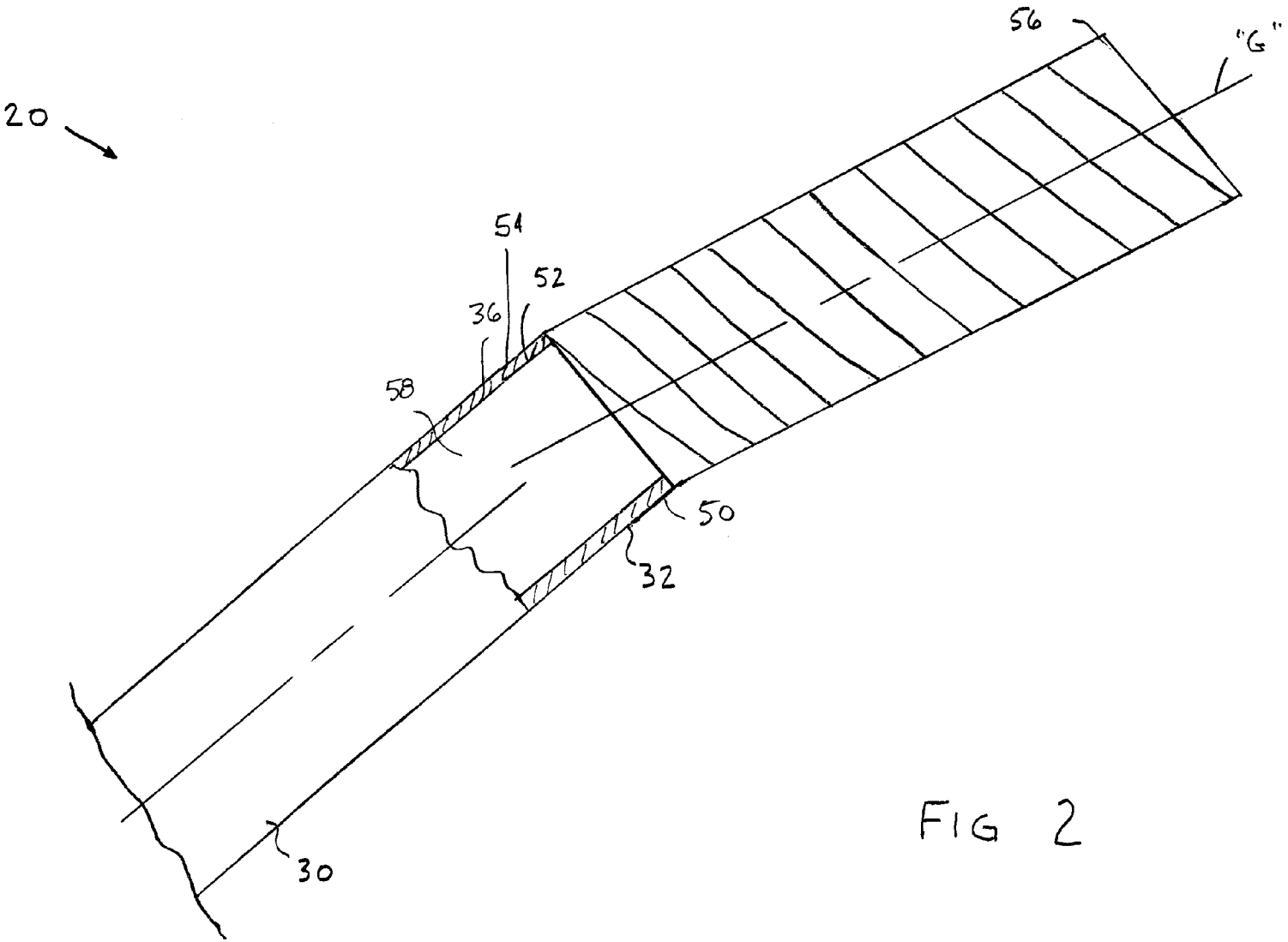
FIG. 2 is an enlarged side elevational view of the upper end of the hockey stick of FIG. 1, with a portion cut away for the sake of clarity.
Figure 3:
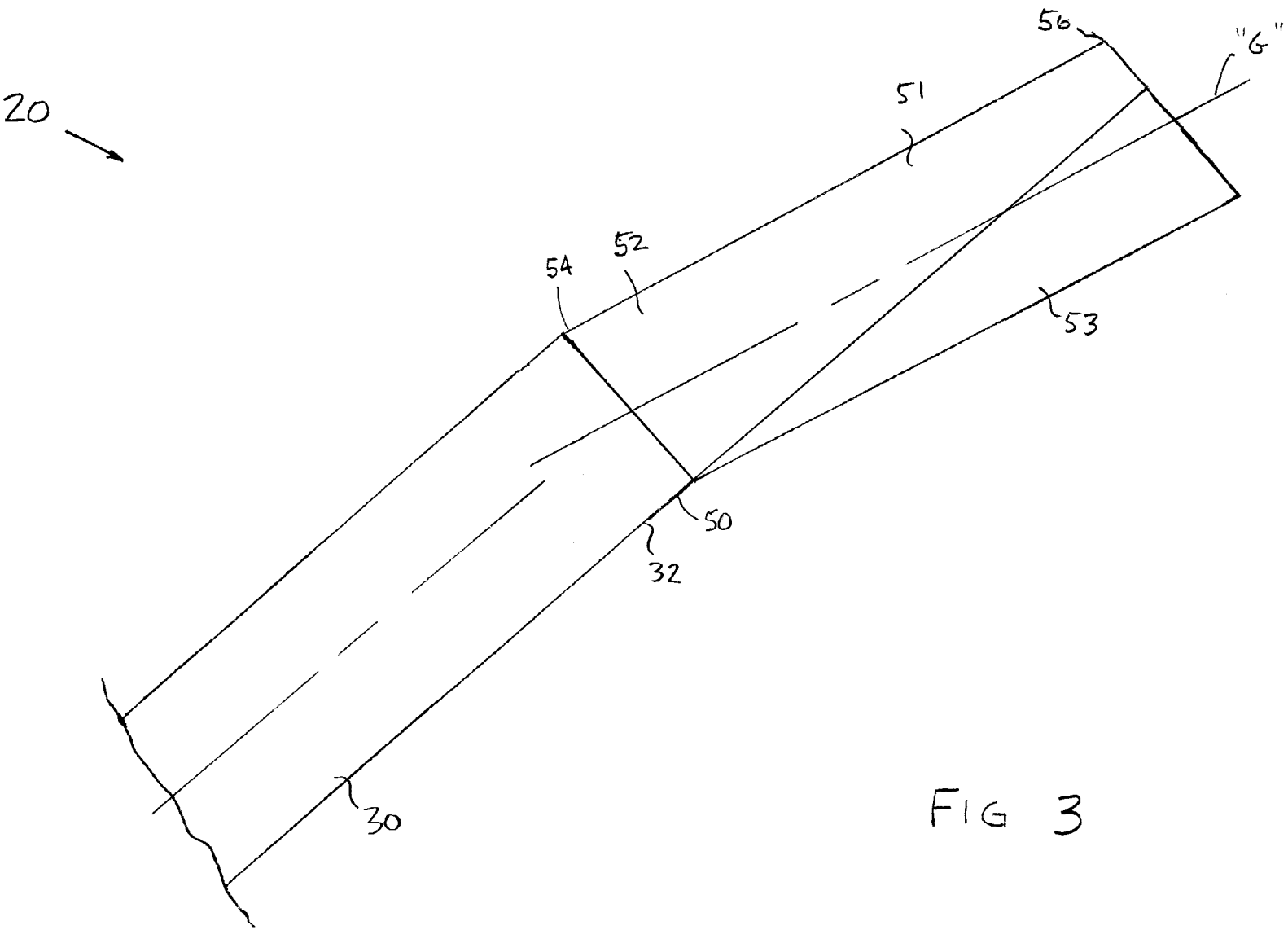
FIG. 3 is a side elevational view similar to FIG. 3, but without hockey tape on the shaft extension.

As can be best seen in FIG. 1, a blade 40, for contacting a hockey puck 42, is securely connected to the elongate shaft 30 at its lower end 34. The blade may be a conventional removable and replaceable wood blade, as is illustrated in FIG. 1, or may be permanently connected to the elongate shaft 30. The blade 40 is shown with hockey tape 44 thereon.

A shaft extension 50 has a grippable portion 52 that in turn has a lower end 54 and an upper end 56. The grippable portion 52 defines a grip longitudinal axis "G" that extends between the lower end 54 and the upper end 52. The grippable portion 52 of the shaft extension 50 is substantially straight along its grip longitudinal axis "G" and is about four and one-half inches long in the first preferred embodiment, as illustrated. The shaft extension 50 also has an insert portion 58 securely connected to the grippable portion 52 at the lower end 54 thereof. The insert portion 58 is shaped and dimensioned so as to be insertable in removable relation into the substantially hollow central portion 36 of the upper end 32 of the elongate shaft 30, and is preferably about three inches long. The insert portion 58 is retained in place in the substantially hollow central portion 36 by conventional means, such as by a suitable adhesive.

Figure 4:
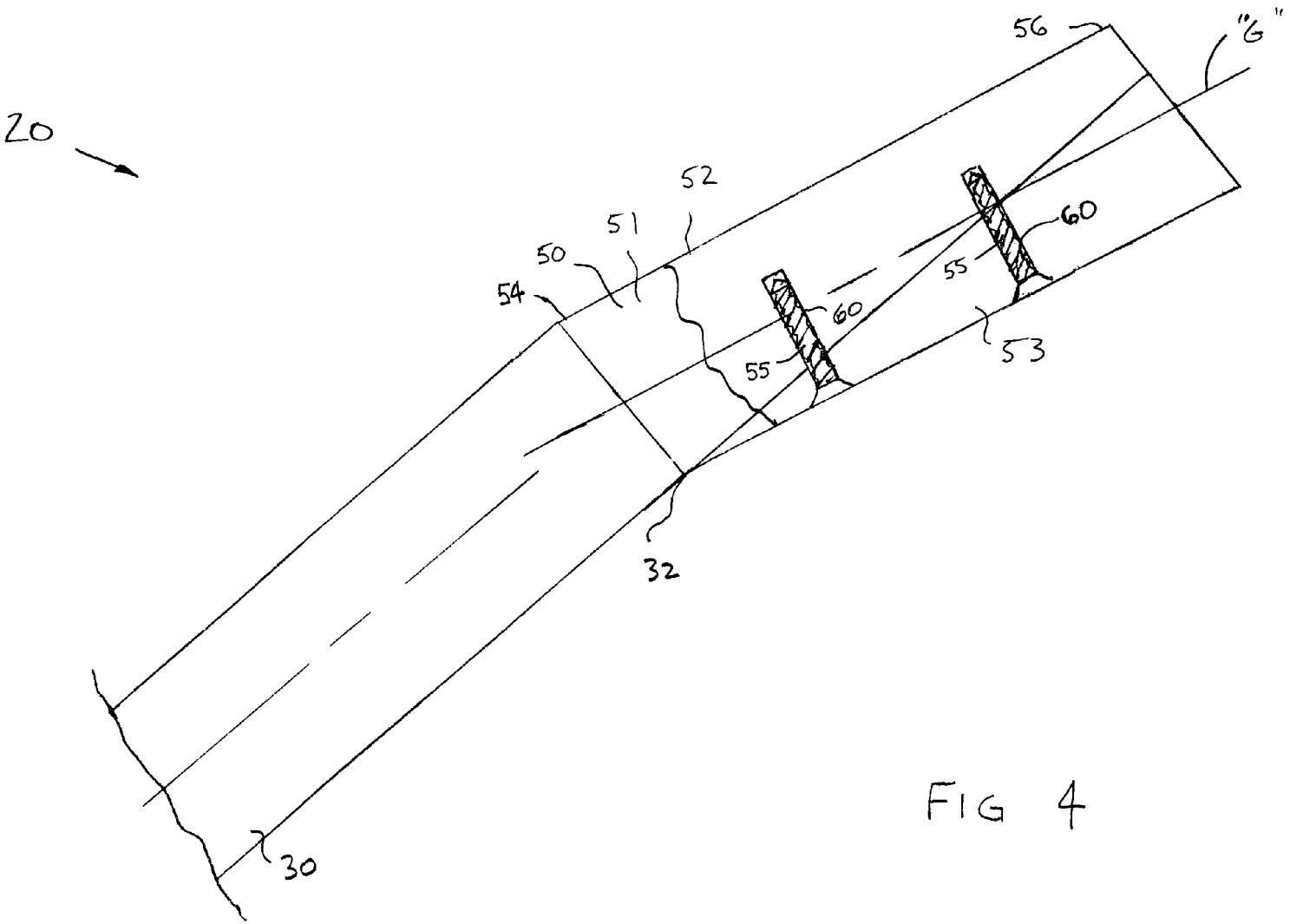
FIG. 4 is a side elevational view similar to FIG. 3, but with a portion cut away for the sake of clarity.
Figure 5:
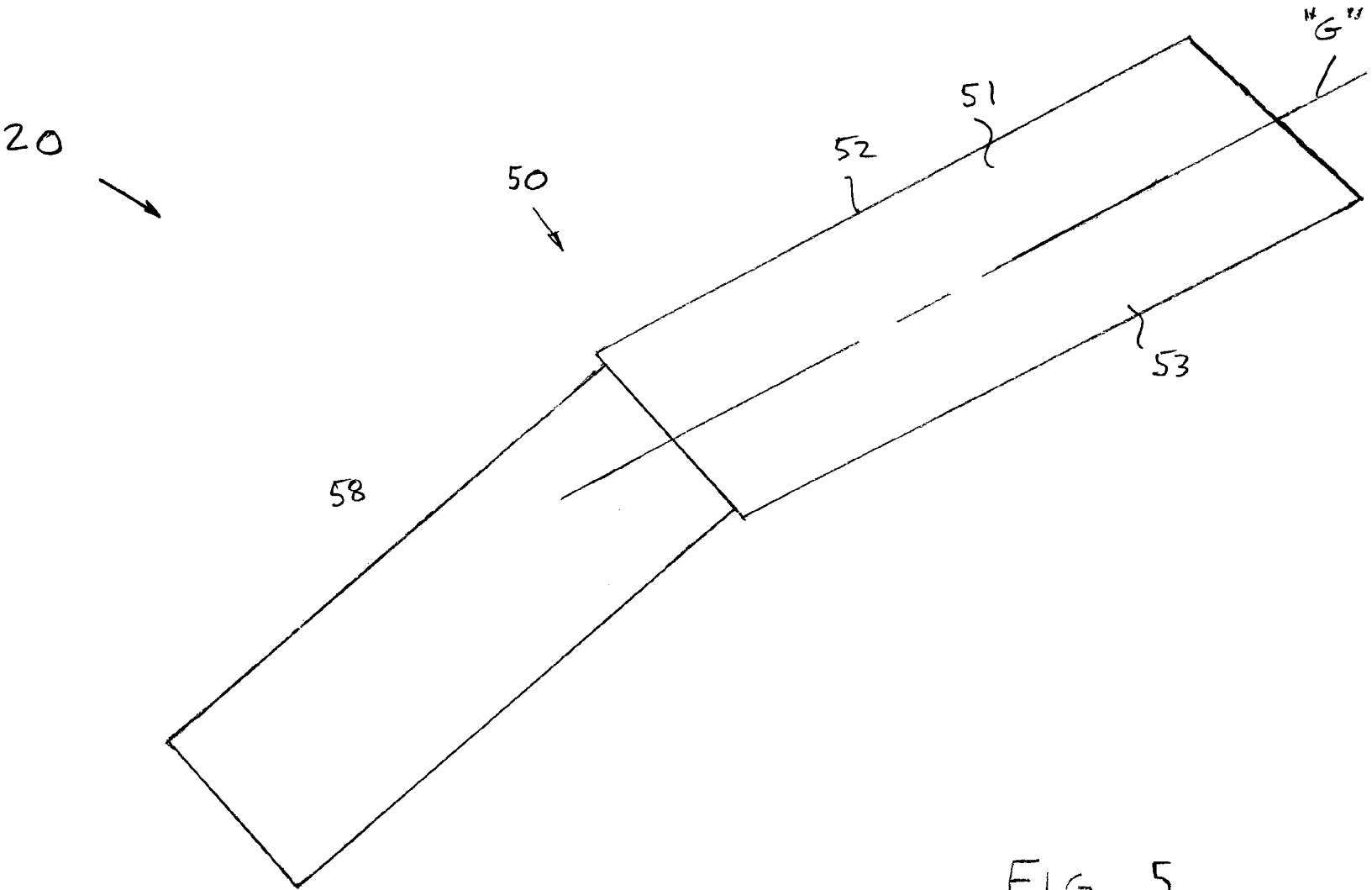
FIG. 5 is a side elevational view of the upper grip portion not installed in a hockey stick.
Figure 6:
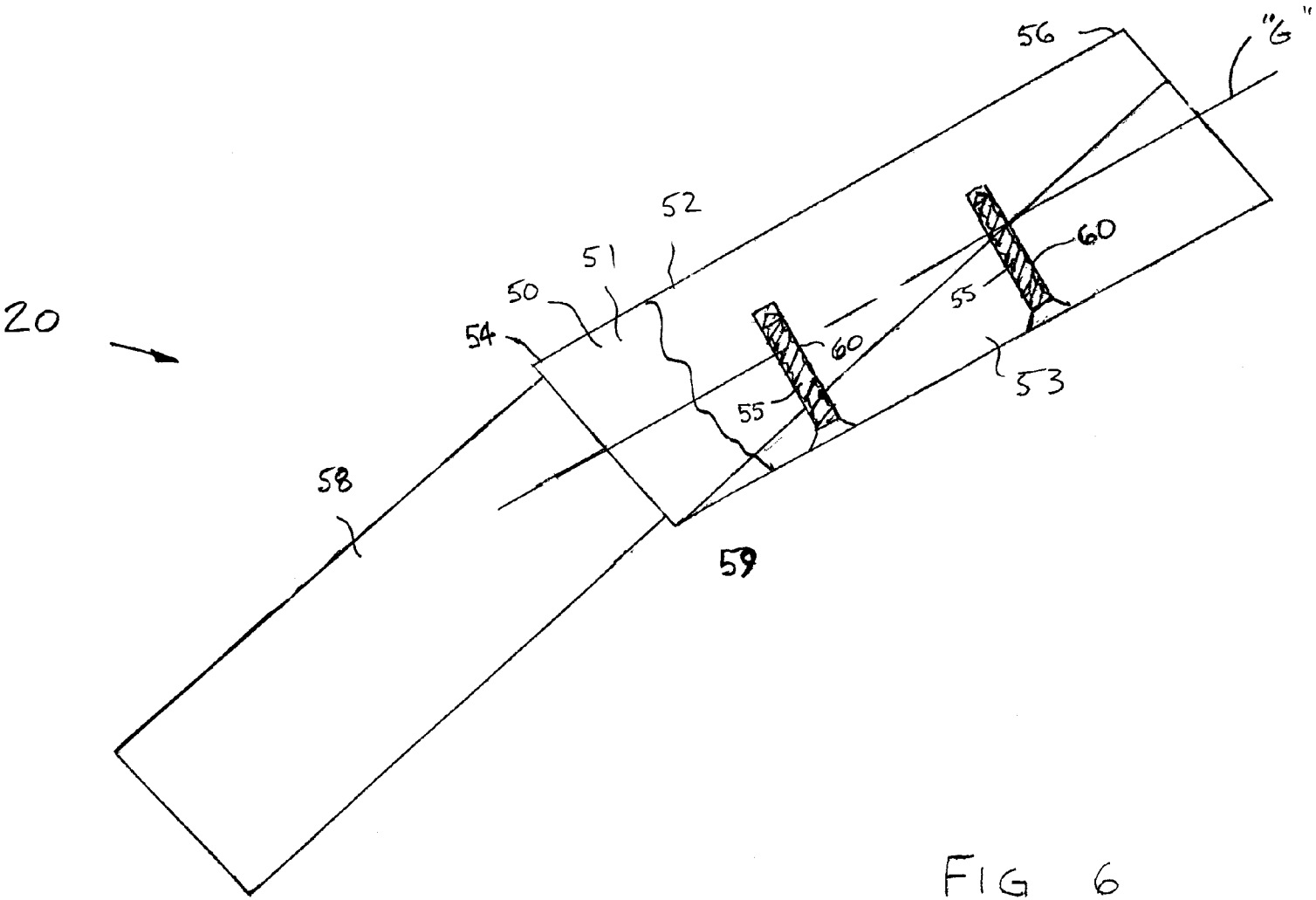
FIG. 6 is a side elevational view of the upper grip portion of FIG. 5, with a portion cut away for the sake of clarity.

The grippable portion 52 comprises a main body 51 and a removable and replaceable portion 53 securely connected to the main body 51 by means of threaded fasteners 55 best in FIGS. 4, 6, and 8, which are one inch long, as shown in the first preferred embodiment.

The insert portion 58 is securely connected to the main body 51 of the grippable portion 52, and in the first preferred embodiment, as illustrated, the insert portion 58 is integrally formed with the main body 51 of the grippable portion 52.

As can be seen in FIGS. 3 through 8, the main body 51 is tapered along its length, from its lower end 54 to a reduced upper end portion 51*a* at its upper end 56. The removable and replaceable portion 53 is co-operatingly tapered, such that, when the removable and replaceable portion 53 is secured to the main body 51, the grippable portion 52 is of substantially constant cross section.

Reference will now be made to FIGS. 5 through 8, which show the shaft extension 50 not inserted into a substantially hollow central portion 36 of an elongate shaft 30. First, reference will be made to FIGS. 5 and 6, which show the removable and replaceable portion 53 secured to the underside 51*u* of the main body 51 by threaded fasteners 55 each passing through a cooperating bore hole 57 in the removable and replaceable portion 53 and in threaded engagement in a cooperating blind hole 60 in the main body 51, as can be best seen in FIG. 6 The bore hole 57 is countersunk at both ends to accommodate the threaded fasteners 55, irrespective which direction the threaded fasteners 55 pass through the bore hole 57. A first outer surface 53*a* contacts the main body 51.

With the shaft extension 50 constructed as such, the grippable portion 52 of the shaft extension 50 is disposed at an angle to the insert portion 58 of the shaft extension 50. In this manner, the insert portion 58 is insertable into the substantially hollow central portion 36 of the upper end 32 of the elongate shaft to thereby securely connect the shaft extension 50 to the elongate shaft 30 such that the grip longitudinal axis "G" is angled below the shaft longitudinal axis "S", thus making the hockey stick 20 more ergonomic and comfortable, so as to not strain a hockey player's upper hand and wrist, and to provide for maximum control of the hockey stick 20. An angle of about nine degrees to about twelve degrees has been found most suitable, but other angles are quite acceptable, depending on the preference of the hocky player using the hockey stick 20.

As can be seen in FIGS. 7 and 8, the removable and replaceable portion 53 may be secured to an upper tapered surface 51*t* of the main body 51 in order to make the shaft extension 50 straight and aligned along the shaft longitudinal axis "S" of the elongate shaft 30, when the shaft extension 50 is inserted therein. Typically, this might be done temporarily when adjusting the feel of the shaft extension 50 of the present invention. In this case, the threaded fasteners 55 are oriented in the bore hole 57 in the opposite direction to that shown in FIG. 6. A second outer surface 53*b* contacts the main body 51. Co-operating blind holes may be provided in the main body 51 to accommodate the threaded fasteners 55.

Reference will now be made to FIG. 9, which shows a second alternative embodiment hockey stick having an angled shaft extension, as indicated by the general reference numeral 220. The second preferred embodiment hockey stick 220 is similar to the first preferred embodiment hockey stick 20, except that the grippable portion 252 of the shaft extension 250 is of unitary construction.

Reference will now be made to FIG. 10, which shows a third alternative embodiment hockey stick having an angled shaft extension, as indicated by the general reference numeral 320. The third preferred embodiment hockey stick 320 is similar to the first preferred embodiment hockey stick 20, except that the shaft extension 350 is of unitary construction with the shaft 330.

Reference will now be made to FIG. 11, which shows a fourth alternative embodiment hockey stick having an angled shaft extension, as indicated by the general reference numeral 420. The fourth preferred embodiment hockey stick 420 is similar to the first preferred embodiment hockey stick 20, except that the shaft extension 450 is significantly longer, and is therefore for use by taller hockey players. The main body 451 extends the entire length of the grippable portion 452, while the removable and replaceable portion 453 is essentially the same size as the removable and replaceable portion 53 in the first preferred embodiment. The insert portion 458 is the same.

As can be understood from the above description and from the accompanying drawings, the present invention provides a hockey stick having an angled shaft extension, which hockey stick is ergonomic and has a comfortable upper grip, which upper grip that does not strain a hockey player's upper hand and wrist, provides for maximum control of the hockey stick, and permits easy sliding action of the hockey player's upper hand between the upper grip and the hockey stick shaft, all of which features are unknown in the prior art.

Other variations of the above principles will be apparent to those who are knowledgeable in the field of the invention, and such variations are considered to be within the scope of the present invention. Further, other modifications and alterations may be used in the design and manufacture of the hockey stick having an angled shaft extension of the present invention without departing from the spirit and scope of the accompanying claims.

I claim:

1. A hockey stick having an angled shaft extension, said hockey stick comprising:

an elongate shaft having an upper end and a lower end and defining a shaft longitudinal axis, said elongate shaft for grasping by the lower hand of a hockey player, and wherein said upper end has a substantially hollow central portion;

a blade securely connected to said elongate shaft at said lower end, said blade for contacting a hockey puck; and, a shaft extension having a grippable portion having a lower end and an upper end, and defining a grip longitudinal axis extending between said lower end and said upper end, and having an insert portion securely connected to said grippable portion at said lower end thereof, wherein said insert portion is insertable into said substantially hollow central portion of said upper end of said elongate shaft, to thereby securely connect said shaft extension to said elongate shaft such that said grip longitudinal axis is angled below said shaft longitudinal axis.

wherein said grippable portion comprises a main body and a removable and replaceable portion secured to said main body, wherein said insert portion is securely connected to said main body of said grippable portion, wherein said main body is tapered to a reduced upper end portion, and wherein said removable and replacedable portion is co-operatingly tapered, such that, when said removable and replaceable portion is secured to said main body, said grippable portion is of substantially constant cross-section.

2. A shaft extension for use with a hockey stick having an elongate shaft defining a grip longitudinal axis and having an upper end with a substantially hollow central portion, said shaft extension comprising:

a grippable portion having a lower end and an upper end and defining a grip longitudinal axis extending between said lower end and said upper end; and an insert portion securely connected to said grippable portion at said lower end thereof, wherein said insert portion is insertable into said substantially hollow central portion of said upper end of said elongate shaft, to thereby securely connect said shaft extension to said elongate shaft such that said grip longitudinal axis is angled below said shaft longitudinal axis, wherein said grippable portion comprises a main body and a removable and replaceable portion secured to said main body, wherein said insert portion is securely connected to said main body of said grippable portion, wherein said main body is tapered to a reduced upper end portion, and wherein said removable and replaceable portion is co-operatingly tapered, such that, when said removable and replaceable portion is secured to said main body, said grippable portion is of substantially constant cross-section.

* * * * *